US006344302B1

(12) United States Patent
Kurose et al.

(10) Patent No.: US 6,344,302 B1
(45) **Date of Patent: *Feb. 5, 2002**

(54) DEVELOPER FOR DEVELOPING ELECTROSTATIC LATENT IMAGES

(75) Inventors: Katsunori Kurose, Amagasaki; Masayuki Hagi, Takatsuki; Tetsuo Sano, Amagasaki; Kenichi Kido, Amagasaki; Takeshi Arai, Amagasaki, all of (JP)

(73) Assignee: Minolta Co., Ltd., Osaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 08/600,368

(22) Filed: Feb. 13, 1996

(30) Foreign Application Priority Data

Feb. 14, 1995 (JP) ..... 7-025441

(51) Int. Cl.[7] ..... G03G 9/087

(52) U.S. Cl. ..... 430/108.6; 430/108.7; 430/109.4; 430/111.35; 430/111.4

(58) Field of Search ..... 430/110, 109, 430/903, 111, 108, 108.6, 108.7, 109.4, 111.4, 111.35

(56) References Cited

U.S. PATENT DOCUMENTS

| | | | | | |
|---|---|---|---|---|---|
| 3,526,533 | A | * | 9/1970 | Jacknow et al. | |
| 4,387,211 | A | * | 6/1983 | Yasuda et al. | 528/179 |
| 4,588,668 | A | * | 5/1986 | Yasuda et al. | 430/109 |
| 4,623,605 | A | | 11/1986 | Kato et al. | 430/110 |
| 4,626,487 | A | | 12/1986 | Mitsuhashi et al. | 430/109 |
| 4,904,558 | A | | 2/1990 | Nagatsuka et al. | 430/122 |
| 5,192,637 | A | * | 3/1993 | Saito et al. | 430/109 |
| 5,272,040 | A | | 12/1993 | Nakasawa et al. | 430/110 |
| 5,320,925 | A | * | 6/1994 | Imai et al. | 430/110 |
| 5,346,792 | A | * | 9/1994 | Kobayashi et al. | 430/109 |
| 5,397,668 | A | * | 3/1995 | Sato et al. | 430/108 |
| 5,429,902 | A | * | 7/1995 | Saito et al. | 430/110 |
| 5,504,559 | A | * | 4/1996 | Ojima et al. | 430/126 |
| 5,604,071 | A | * | 2/1997 | Okada et al. | 430/110 |
| 5,705,303 | A | * | 1/1998 | Ichimura et al. | 430/110 |
| 5,747,211 | A | * | 5/1998 | Hagi et al. | 430/110 |
| 5,824,442 | A | * | 10/1998 | Tanikawa et al. | 430/45 |

FOREIGN PATENT DOCUMENTS

| | | | | |
|---|---|---|---|---|
| EP | 0495475 | * | 7/1992 | 430/109 |
| GB | 2100873 | * | 1/1983 | |

OTHER PUBLICATIONS

Brandrup et al., eds. *Polymer Handbook*, 2nd ed., Wiley–Interscience Publication, NY (1975), pp. IV–337 to IV–342, IV–344.*

Caplus Abstract AN: 1986: 26769 (1986) of JP 60121454.*

A.S. Diamond, ed. *Handbook of Imaging Materials*, Marcel Dekker, Inc., NY (1991), p. 169.*

Caplus Abstract AN 1994: 334907 (1994) of JP 5–313406.*

* cited by examiner

*Primary Examiner*—Janis L. Dote

(74) *Attorney, Agent, or Firm*—McDermott, Will & Emery

(57) ABSTRACT

A developer for developing an electrostatic latent image comprising:

toner particles comprising a colorant and a binder resin, said toner particles having a volume-average particle size of 5 to 10 $\mu$m;

a first exterior additive comprising hydrophobic titanium oxide powder or hydrophobic aluminum oxide powder; and a second exterior additive comprising a silica powder; said developer satisfying following relationships:

$$S_1 > S_2$$

$$400 < \sqrt{(S_1^2 + S_2^2)} \leqq 1300.$$

wherein $S_1$ ($m^2$) denotes total specific surface area of the first additive per 1 kg of the toner and $S_2$ ($m^2$) denotes that of the second additive.

17 Claims, 1 Drawing Sheet

DEVELOPER FOR DEVELOPING ELECTROSTATIC LATENT IMAGES

BACKGROUND OF THE INVENTION

1. Field of the Invention

The present invention relates to a developer for developing electrostatic latent images in electrophotography, electrostatic recording, electrostatic printing and the like.

2. Description of the Related Art

In developers used for developing electrostatic latent images formed on a latent image-bearing member in electrophotography, electrostatic recording, and electrostatic printing, storage characteristics (blocking resistance), transport characteristics, developing characteristics, transfer characteristics, charging characteristics, and fixing characteristics are particularly important. Heretofore, many means have been proposed for improving the above-mentioned characteristics. One such proposal has been a method wherein additives are added to the toner to improve flow characteristics and environmental resistance.

A common additive externally added to toner (hereinafter referred to as "exterior additive") are silica microparticles and titania microparticles and the like. Conventionally, silica microparticles are used as a main exterior additive, used principally for maintaining flow characteristics. The silica microparticles are themselves easily affected by temperature and humidity, and are particularly subject to a large rise in charge under conditions of low humidity, which causes problems with the charge stability of the toner.

On the other hand, titania is not as readily affected by temperature and humidity compared to silica, but when titania microparticles are used as a main additive, the charge level of the toner is reduced due to the low charge level of the titania itself, thereby causing disadvantages of airborne dispersion and fog over long term use.

For these reasons silica microparticles are used to maintain toner flow characteristics and titania microparticles are added to minimize the adverse affects of temperature and humidity on the silica. The use of silica as a main exterior additive and titania as an adjunct exterior additive has been proposed (e.g., U.S. Pat. No. 4,904,558). Accordingly, when viewed from the overall developer, the developer characteristics largely depend on silica, and are easily affected by temperature and humidity.

Particularly when polyester resin is used as the toner binder resin, the polyester resin itself poses marked disadvantages in that it is readily influenced by temperature and humidity fluctuations due to the presence of hydrophilic groups such as ester bonds, hydroxyl groups, carboxyl groups and the like.

SUMMARY OF THE INVENTION

An object of the present invention is to eliminate the previously described disadvantages by providing a novel developer for developing electrostatic latent images.

Another object of the present invention is to provide a developer having stable charging and developing characteristics.

Still another object of the present invention is to provide a developer that is not susceptible to temperature or humidity fluctuations.

Further object of the present invention is to provide a developer that prevents spent carrier, provides sharp and fogless images, and has excellent stability over time.

The above-mentioned object is achieved by a developer, which is preferred embodiment of the present invention, comprising:

toner particles comprising a colorant and a binder resin, said toner particles having a volume-average particle size of 5 to 10 $\mu$m;

a first exterior additive comprising a powder selected from the group consisting of hydrophobic titanium oxide powders and hydrophobic alumina powder; and a second exterior additive comprising a silica powder; said developer satisfying following relationships:

$$S_1 > S_2$$

$$400 < \sqrt{(S_1^2 + S_2^2)} \leqq 1300.$$

wherein $S_1$ ($m^2$) denotes total specific surface area of the first additive per 1 kg of the toner and $S_2$ ($m^2$) denotes that of the second additive, wherein said total specific surface areas $S_1$ and $S_2$ are represented by following formulas:

$$S_1 = A_1 \cdot B_1$$

$$S_2 = A_2 \cdot B_2$$

wherein $A_1$ ($m^2$/g) denotes BET specific surface area of the first additive, $A_2$ ($m^2$/g) denotes that of the second additive, $B_1$ (g) denotes content of the first additive per 1 kg of the toner, and $B_2$ (g) denotes that of the second additive.

DESCRIPTION OF THE PREFERRED EMBODIMENTS

Figure 1:
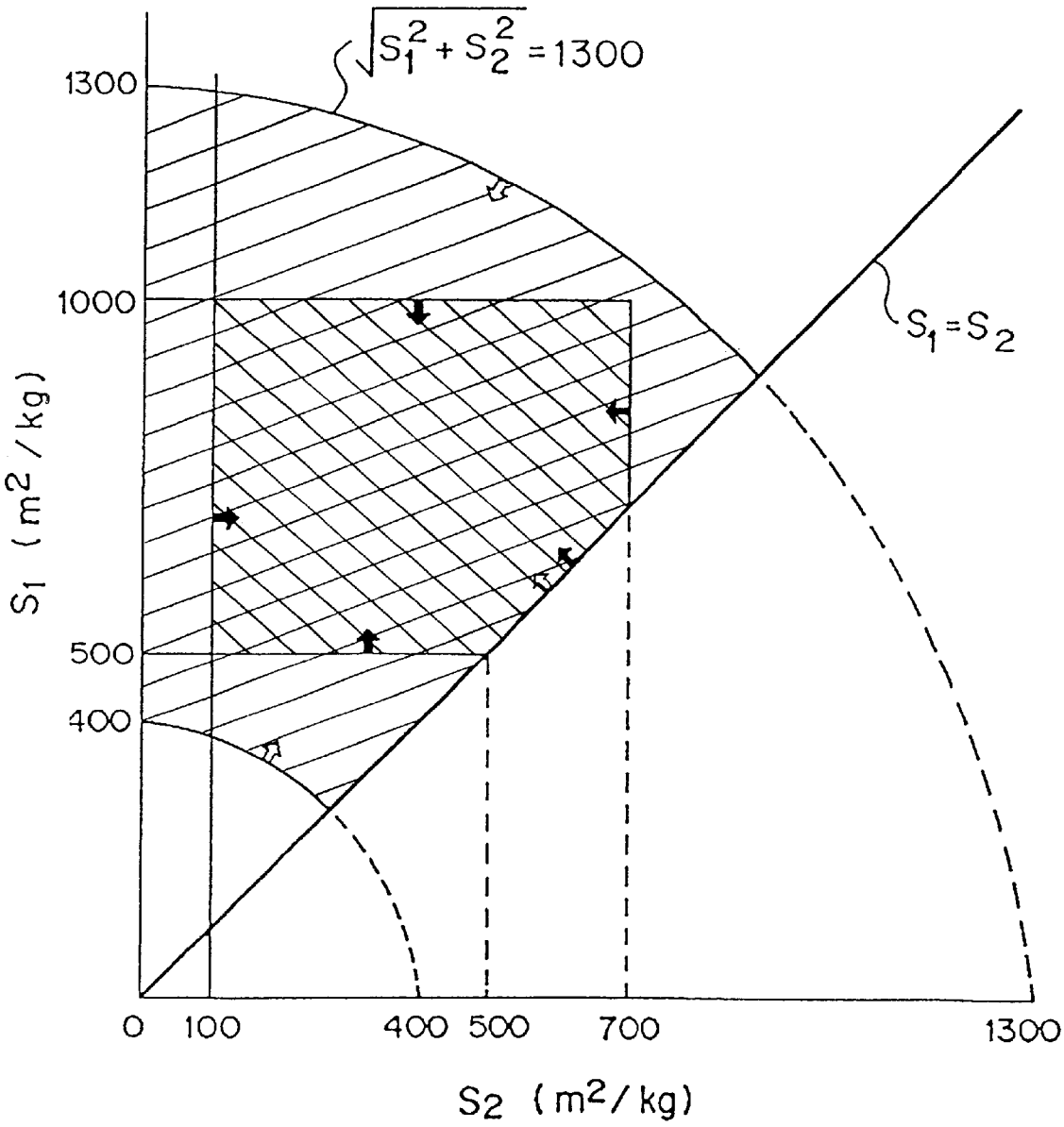
FIG. 1 shows the relationship of the total specific surface areas of the first and second exterior additives.

The preferred embodiments of the developer of the present invention comprise toner particles formed of at least colorant and binder resin, and first and second exterior additives adhered to the toner particle surface.

First exterior additive is made of hydrophobic titanium oxide microparticles or hydrophobic alumina microparticles. And second exterior additive is made of silica microparticles. The first and second exterior additives have total specific surface areas $S_1$ and $S_2$ ($m^2$) relative to 1 kg of toner particles which satisfy the following relational expressions.

$$S_1 > S_2 \quad \text{(I)}$$

$$400 < \sqrt{(S_1^2 + S_2^2)} \leqq 1300 \quad \text{(II)}$$

In relational expressions (I) and (II), the total specific surface area $S_1$ and $S_2$ ($m^2$/kg) of the respective exterior additives are represented by following formulas:

$$S_1 = A_1 \cdot B_1 \quad \text{(III)}$$

$$S_2 = A_2 \cdot B_2 \quad \text{(IV)}$$

wherein $A_1$ ($m^2$/g) denotes BET specific surface area of the first additive, $A_2$ ($m^2$/g) denotes that of the second additive, $B_1$ (g) denotes content of the first additive relative to 1 kg of toner particles, and $B_2$ (g) denotes that of the second additive.

FIG. 1 shows the relationship of the above expressions (I) and (II); $S_1$ is represented on the vertical axis, and $S_2$ is represented on the horizontal axis. In FIG. 1, the diagonally shaded portion is the region circumscribed by the $S_1$ axis and line $S_1=S_2$, and two curves expressing circles $\sqrt{(S_1^2+S_2^2)}=400$ and $\sqrt{(S_1^2+S_2^2)}=1,300$, and expresses the range stipulated by expressions (I) and (II).

When first and second exterior additives are used which have a relationship in the range $S_1>S_2$ and $\sqrt{(S_1^2+S_2^2)}>1,300$ in FIG. 1, disadvantages such as filming and black spots occur in conjunction with detachment of the exterior additives. When first and second exterior additives are used which have a relationship in the range $S_1 \leqq S_2$, environmental stability deteriorates as the amount of silica present on the toner particle surface becomes relatively plentiful, thereby causing filming and the like in conjunction with silica detachment. In addition, suitable flow characteristics cannot be obtained when first and second exterior additives are used which have a relationship in the range $S_1>S_2$ and $\sqrt{(S_1^2+S_2^2)} \leqq 400$.

It is desirable that the first and second exterior additives are added so as to be within the crosshatched region of FIG. 1, i.e., so as to satisfy the conditions below.

$$S_1>S_2 \quad \text{(I)}$$

$$500 \leqq S_1 \leqq 1,000 \quad \text{(V)}$$

$$100 \leqq S_2 \leqq 700 \quad \text{(VI)}$$

It is desirable that the hydrophobic titanium oxide microparticles and hydrophobic alumina microparticles used as the first exterior additive are subjected to hydrophobic processing to obtain a hydrophobicity of 40% or more.

The coupling agents used for hydrophobic processing in the manufacture of the above-mentioned hydrophobic titanium oxide microparticles and hydrophobic alumina microparticles may be conventional silane coupling agents typically used for hydrophobic processing of titanium oxide and alumina.

Desirable method of hydrophobic processing is method which hydrolyze the coupling agent while mechanically dispersing titanium oxide microparticles or alumina microparticles in an aqueous solvent medium to achieve a primary particle size. This method is relatively economical and simple from a manufacturing standpoint, and preferable from a standpoint that solvent is not used.

Examples of titanium oxide include crystalline titania such as anatase titania and rutile titania, amorphous titania and the like. Crystalline titania is particularly preferable form standpoints of cost and manufacturing simplicity. Amorphous titania can be obtained by methods wherein volatile titanium alkoxide is subjected to low temperature oxidation and treatment for particle sphericalization, and thereafter surface processing to obtain amorphous spherical titania particles.

BET specific surface area of the first exterior additive is desirably 70~200 $m^2/g$, preferably 80~150 $m^2/g$, and further preferably 90~140 $m^2/g$ after hydrophobic processing.

Titania microparticles having a specific surface area of 70~200 $m^2/g$ after hydrophobic processing can be obtained by, for example, subjecting to above-mentioned hydrophobic processing titania microparticles having a mean particle size of 5~50 nm produced by vapor phase method or wet-type methods such as chlorination method and sulfation method.

Alumina microparticles having a specific surface area of 70~200 $m^2/g$ after hydrophobic processing can be obtained by, for example, subjecting to above-mentioned hydrophobic processing alumina microparticles having a mean particle size of 10~50 nm produced by wet-type method or vapor phase method.

The silica microparticles used as the second exterior additive may be manufactured by either dry-type or wet-type methods. It is desirable that the silica microparticles is treated by a hydrophobic agent such as silane coupling agent or the like.

BET specific surface area of the second exterior additive is desirably 50~300 $m^2/g$, preferably 70~250 $m^2/g$, and ideally 100~200 $m^2/g$. In the case of silica microparticles treated with hydrophobic processing, the BET specific surface area is value measured after hydrophobic processing.

The obtained developer may be used as any developer which has a fluidizing agent exteriorly applied to toner particles. For example, the obtained developer may be used as a developer used in image forming apparatuses which form images at high speed, a developer used in image forming apparatuses using so-called oilless fixing wherein silicone oil is not applied as a release agent to a fixing member used for contact-type fixing of a toner image on a paper sheet, a developer using a magnetic toner, or a developer using color toner in full color image forming apparatuses. The obtained developer may also be used as a monocomponent developer or a two-component developer including carrier particles.

The mean particle size of the toner particles is desirably 5~10 $\mu$m, and when reproducing high resolution images the mean particle is preferably 5~9 $\mu$m, and further preferably 5~8 $\mu$m.

Toner particles are prepared by dispersing a colorant such as carbon black and the like and other desired additives within the binder resin. The binder resin may include a mixture comprising a first and second resin, the second resin having a different softening point from that of the first resin.

Examples of useful toner binder resins include thermoplastic resins such as polystyrene resin, poly(meth)acrylic resin, polyolefin resin, polyamide resin, polycarbonate resin, polyether resin, polysulfone resin, polyester resin, epoxy resin, butadiene resin and the like, and thermosetting resins such as urea resin, urethane resin, epoxy resin and the like, and copolymers, block polymers, graft polymers, and polymer blends thereof. Furthermore, the above-mentioned resins are not limited to, for example, complete polymers of thermoplastic resin, and may contain oligomers or prepolymers, and bridging agents and the like in thermosetting resins.

When the developer is used in image forming apparatus that forms images at high speed, it is necessary to fix the toner quickly to the sheet and improve separation from the fixing roller, such that it is desirable to use as the binder resin polyester resins or homogeneous polymers or copolymers comprising styrene monomer, (meth)acrylic monomers, (meth)acrylate monomers.

It is desirable that the binder resin have a number-average molecular weight Mn and weight-average molecular weight Mw such that $1,000 \leqq Mn \leqq 10,000$, $20 \leqq Mw/Mn \leqq 70$, and preferably $2,000 \leqq Mn \leqq 7,000$.

When used in an image forming apparatus using oilless fixing, the toner binder resin desirably has a glass transition temperature of 55~80° C., softening point of 80~150° C., and contains 5~20 percent-by-weight gelated component.

Resins used as a binder for color toners in full color image forming apparatuses is preferably a polyester resin having Mn of 3,000~6,000, Mw/Mn of 2~6, glass transition temperature of 50~70° C., and softening point of 90~110° C.

In the case of toner using polyester resin used in full color image forming apparatuses, the addition of the previously mentioned first and second exterior additives are particularly effective when added to toner using polyester resin comprising aromatic diol and aliphatic dicarboxylic acid or aromatic dicarboxylic acid.

Examples of useful aromatic diols include bisphenol A (poly)oxypropylene adduct, bisphenol A (poly)oxyethylene adduct and the like.

Examples of useful materials which can be used together with the above-mentioned aromatic diols include diols such as ethylene glycol, diethylene glycol, triethylene glycol, 1,2-propylene glycol, 1,3-propylene glycol, 1,4-butane diol, neopentyl glycol, and polyvalent alcohols such as sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, 1,3,5-trihydroxymethylbenzene and the like.

Examples of useful aliphatic dicarboxylic acid used in the above-mentioned polyester resin include aliphatic dicarboxylic acids such as fumaric acid, maleic acid, succinic acid, alkyl or alkenylsuccinic acid with 4~18 carbon atoms, or acid anhydrides or low-molecular weight alkyl esters thereof.

Examples of useful aromatic dicarboxylic acids include aromatic dicarboxylic acids such as terephthalic acid, isophthalic acid and the like, and acid anhydrides and low-molecular weight alkyl esters thereof.

Polyvalent carboxylic acids such as trimellitic acid and the like may be used to regulate the resin acid value when used sparingly within a range that does not impair toner transmittancy. Examples of useful polyvalent carboxylic acid components include 1,2,4-benzenetricarboxylic acid (trimellitic acid), 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl) methane, 1,2,7,8-octanetetracarboxylic acid, pyromellitic acid, anhydrides and low-molecular weight alkyl esters thereof.

Among the polyester resins produced by the previously described alcohol components and acid components, polyester resins formed by combined use of bisphenol A (poly) oxyethylene adduct and bisphenol A (poly)oxypropylene adduct as aromatic diol component, and acid component selected from aromatic dicarboxylic acid, aliphatic dicarboxylic acid, and trimellitic acid is desirable for the binder resin of the toner used for full color image formation be a polyester resin.

The polyester resin used for full color is preferably dissolved in tetrahydrofuran and does not contain components which are insoluble in tetrahydrofuran. When the polyester resin contains components which are insoluble in tetrahydrofuran, toner transmittancy may be impaired.

Various types of colorants may be used.

Examples of representative useful blue dyes and pigments include C.I. 74100 (nonmetallic phthalocyanine), C.I. 74160 (phthalocyanine), C.I. 74180 (fast sky blue) and the like.

Examples of representative useful red dyes and pigments include C.I. 12055 (STERLING I), C.I. 12075 (permanent orange), C.I. 12175 (LITHOL FAST ORANGE 3GL), C.I. 12305 (permanent orange GTR), C.I. 11725 (HANZA YELLOW 3R), C.I. 21165 (VULCAN FAST ORANGE GG), C.I. 21110 (benzidine orange G), C.I. 12120 (permanent red 4R), C.I. 1270 (para red), C.I. 12085 (fire red), C.I. 12315 (brilliant fast scarlet), C.I. 12310 (permanent red F2R), C.I.12335 (permanent red F4R), C.I. 12440 (permanent red FRL), C.I. 12460 (permanent red FRLL), C.I. 12420 (permanent red F4RH), C.I. 12450 (light fast red toner B), C.I. 12490 (permanent carmine FB), C.I. 15850 (brilliant carmine 6B) and the like.

Examples of representative useful yellow dyes and pigments include C.I. 10316 (naphthol yellow S), C.I. 11710 (HANZA YELLOW 10G), C.I. 1160 (YELLOW 5G), C.I. 11670 (HANZA YELLOW 3G), C.I. 11680 (HANZA YELLOW G), C.I. 11730 (HANZA YELLOW GR), C.I. 11735 (HANZA YELLOW A), C.I. 11740 (HANZA YELLOW RN), C.I. 12710 (HANZA YELLOW R), C.I. 12720 (pigment yellow L), C.I. 21090 (benzidine yellow), C.I. 21095 (benzidine yellow G), C.I. 21100 (benzidine yellow GR), C.I. 20040 (permanent yellow NCG), C.I. 21220 (VULCAN FAST YELLOW 5), C.I. 21135 (VULCAN FAST YELLOW R) and the like.

Examples of useful black pigment include carbon black, copper oxide, manganese dioxide, aniline black, active carbon, ferrite, magnetite and the like.

These colorants may be used individually or in combinations of two or more, but it is desirable that said colorant content is 1 to 10 parts-by-weight, and preferably 2 to 5 parts-by-weight relative to 100 parts-by-weight of binder resin contained in the toner particles. That is, more than 10 parts-by-weight may cause a reduction in toner fixing characteristics and transmittancy, whereas less than 1 part-by-weight may not produce the desired image density.

Charge-control agents, off-set preventing agents and the like may be added to the toner.

Either positive charge-control agents or negative charge-control agents may be used as charge-control agents in the above-mentioned toner.

Examples of useful positive charge-control agents include nigrosine base EX, BONTRON N-01, 02, 04, 05, 07, 09, 10, and 13 (Orient Chemical Co., Ltd.), oil black (Chuo Gosei Kagaku K.K.), quaternary ammonium salt P-51 (Orient Chemical Co., Ltd), polyamine compound P-52 (Orient Chemical Co., Ltd.), SUDAN CHIEF SCHWALTZ BB (SOLVENT BLACK 3; C.I. No. 26150), FETT SCHWALTZ HBN (C.I. No. 26150), alkoxyamine, alylamide, molybdic acid chelate pigment, imidazole compounds and the like.

Examples of useful negative charge-control agents include azo dye chrome complex salts S-32, 33, 34, 35, 37, 38, and 40 (Orient Chemical Co., Ltd.), AIZEN SPILON BLACK TRH, BHH (Hodogaya Kagaku K.K.), KAYASET BLACK T-22, 004 (Nihon Kayaku K.K.), copper phthalocyanine dye S-39 (Orient Chemical Co., Ltd.), chromium complex salt E-81, E-82 (Orient Chemical Co., Ltd.), zinc complex salt E-84 (Orient Chemical Co., Ltd.), aluminum complex salt (Orient Chemical Co., Ltd.), calix arene compounds and the like.

Charge-control agents are preferably added in an amount of 0.01 to 10 parts-by-weight relative to 100 parts-by-weight toner binder resin. Charge-control agent may be attached to the surface of the toner particles. When a charge-control agent is attached to the surface of the toner particles, a lesser amount of additive is needed than when the charge-control agent is dispersed within the toner particles, e.g., an added amount of about 0.05 to 2 parts-by-weight is suitable.

Examples of useful off-set preventing agents include polyolefin waxes such as low molecular weight polyethylene wax, low molecular weight oxidized-type polypropylene wax, higher fatty acid wax, higher fatty acid ester wax, Fishcer-Tropsch wax, candellila wax, carnauba wax, and mixtures thereof.

It is desirable that off-set preventing agents are added at a rate of 0.1 to 10 parts-by-weight, and preferably 1 to 5 parts-by-weight, relative to 100 parts-by-weight of toner binder resin.

Well known conventional mechanical mixing methods may be used as methods for externally adding above-mentioned first and second exterior additives to the toner particles, e.g., mixing devices such as the henschel mixer, super mixer, powder mixer, homogenizer and the like. Black developer using black toner containing black colorant may be used as a two-component developer when mixed with carrier particles, or as a monocomponent developer without carrier particles.

Carrier particles used in combination with the toner particles may be well known conventional carrier particles used for two-component developers, e.g., carrier particles comprising magnetic particles such as ferrite, iron and the like, resin-coated carriers wherein the magnetic particles are coated with a resin outerlayer, or binder-type carriers having magnetic powder dispersed in a binder resin. Among these carrier particles, resin coated carriers using a polyester resin or vinyl monomer and copolymer (graft resin) of silicone resin and organopolysiloxane as the coated resin, or binder-type carriers using polyester resin as a binder resin are desirable form the perspective of preventing toner spent and the like, and carriers coated with resin obtained by reacting isocyanate with copolymer resins of organosiloxane and vinyl monomer are particularly desirable from the perspectives of durability, environmental stability, and anti-spent characteristics. The average size of carrier particles is desirably 30 to 60 $\mu$m to assure high image quality and prevent carrier-induced fog.

The present invention is described by way of specific examples below. In the following description, "parts" refers to "parts-by-weight" unless otherwise specified.

Production of Toner 1

To 100 parts of a linear polyester resin (Mn: 4,500; Mw/Mn: 2.3; glass transition point: 60.2° C.; softening point: 100.3° C.) containing no materials which are insoluble in tetrahydrofuran and comprising bisphenol A propylene oxide (PO) and bisphenol A ethylene oxide (EO) as alcohol components, and fumaric acid (FA) and terephthalic acid (TPA) as acid components were added 3 parts phthalocyanine pigment, and 2.0 parts salicylic acid derivative zinc complex salt as a charge-control agent, and the materials were thoroughly mixed in a henschel mixer.

After the obtained mixture was kneaded in a dual shaft extrusion kneader, it was cooled. The kneaded material was coarsely pulverized using a feather mill, and then finely pulverized using a jet mill.

The finely pulverized material was then classified to obtain toner particles 1 having a volume-average particle size of 8.1 $\mu$m.

| Production of Toner 2 | |
|---|---|
| Polyester resin X (softening point 104.9° C.) | 65 parts |
| Polyester resin Y (softening point 148.8° C.) | 35 parts |
| Oxidized-type polypropylene (BISCOL TS-200; Sanyo Kasei K.K.) | 3 parts |
| Negative charge-control agent (BONTRON S-34; Orient Chemical Co., Ltd.) | 5 parts |
| Carbon black (MOGUL L; Cabot Co.) | 8 parts |

These materials were thoroughly mixed using a henschel mixer, then fused and kneaded using a dual shaft extrusion kneader. After cooling, the mixture was coarsely pulverized using a hammer mill, then finely pulverized using a jet mill, and subsequently classified to obtain toner particles 2 having a volume-average particle size of 8.0 $\mu$m.

Polyester resin X was obtained by condensation reaction of bisphenol A propylene oxide (PO) and bisphenol A ethylene oxide (EO) as alcohol components, and terephthalic acid and trimellitic acid as acid components.

Polyester resin Y was obtained by condensation reaction of bisphenol A propylene oxide (PO) and bisphenol A ethylene oxide (EO) as alcohol components, and terephthalic acid and succinic acid, and trimellitic acid as acid components to achieve a predetermined acid value.

Production of Carrier 1

A mixer, condenser, thermometer, and $N_2$ gas tube were attached to a 500 ml flask provided with a titration device, and 100 parts MEK was introduced therein. Then, 36.7 parts MMA, 5.1 parts HEMA, 58.2 parts MPTS (organopolysiloxane), and 1 part V-40 were dissolved in 100 parts MEK under nitrogen atmosphere at 80° C. to obtain a solvent solution which was titrated into the flask over 2 hr period. A resin was obtained by heating the material for 5 hr.

The MPTS (organopolysiloxane) represents 3-methacryloxypropyltris(trimethylsiloxane) silane, V-40 comprises 1,1'-azobis(cyclohexane-1-carbonitrile), MEK represents methylethylketone, MMA represents methylmethacrylate, and HEMA represents 2-hydroxyethylmethacrylate.

The obtained synthetic resin was added isophorone diisocyanate/trimethylolpropane adduct (IPDI/TMP: NCO %=6.1%) to achieve an OH/NCO molar ratio of 1/1, then the material was diluted with MEK to obtain a coating resin solution having a constant ratio of 3 percent-by-weight. The OH of the above-mentioned OH/NCO molar ratio specifies the OH in the synthetic resin.

The above-mentioned coating resin solution was applied using a spillar coater (Okada Seiko K.K.) on a sintered ferrite powder F-300 (mean particle size: 50 $\mu$m; bulk density: 2.53 g/cm$^3$; Powder Tech K.K.) as a core material so as to achieve a coating of 1.5 percent-by-weight.

After drying, the obtained resin coating particles were sintered by allowing to stand for 1 hr at 160° C. in an oven with internal heat air circulation. After cooling, bulk ferrite powder was cracked using an oscillator with 106 and 75 mounted meshes to obtain resin coated carrier 1.

Production of Carrier 2

A solution of polyester resin comprising ethyleneglycol and neopentylglycol as alcohol components, and isophthalic acid and terephthalic acid as acid components was applied to Cu—Zn ferrite particles having a mean particle size of 45 $\mu$m so as to achieve a coating application of 0.4 percent-by-weight. After drying, the material was cracked to obtain carrier 2 coated by polyester resin.

| Production of Carrier 3 | |
|---|---|
| Polyester resin (Mn: 5,000; Mw: 115,000; Tg: 67° C.; Tm: 123° C.) | 100 parts |
| Ferrite microparticles (MFP-2; TDK Co., Ltd.) | 500 parts |

After these material were thoroughly mixed using a henschel mixer, it was fusion kneaded using a dual shaft extrusion kneader, cooled, and coarsely pulverized. This coarsely pulverized material was finely pulverized using a jet mill, then classified using a force air classification device to obtain carrier 3 having a mean particle size of 60 $\mu$m.

EXAMPLES 1~11 AND REFERENCE EXAMPLES 1~9

Silica and titania were used in the combinations and amounts (number of grams per 1 kg toner) listed in Table 1 and added to the exterior of toners 1 and 2. The types of silica and titania in Table 1 are described below.

Titania A: Hydrophobic titania STT-30A (Titanium Kogyo K.K.; anatase type; BET specific surface area: 110 $m^2/g$)

Titania B: Titania MT-150 (Teika K.K.; rutile type) treated by hydrophobic processing with silane coupling agent (BET specific surface area: 80 $m^2/g$ after hydrophobic processing)

Titania C: Hydrophobic titania T-805 (AEROSIL K.K.; BET specific surface area: 35 $m^2/g$)

Alumina D: Hydrophobic alumina RFY-C (AEROSIL K.K.; BET specific surface area: 90 $m^2/g$)

Silica I: Hydrophobic silica H2000 (Hoechst Co.; BET specific surface area: 140 $m^2/g$)

Silica II: Hydrophobic silica TS-500 (Cabosil Co.; BET specific surface area: 225 $m^2/g$)

Silica III: Hydrophobic silica SS-50 (Nippon silica K.K.; BET specific surface area: 75 $m^2/g$)

Carriers 1~3 were mixed with toners having an exterior additive of the above-mentioned silica, titania or alumina in the amounts shown in Table 1 to achieve a toner density of 7 percent-by-weight so as to obtain the developers of examples 1~11 and reference examples 1~9.

Developer Evaluation

The developers of examples 1~6 and 9~11, and reference examples 1~9 which used toner 1 were used in a full color electrophotographic copying machine model CF-80 (Minolta Co., Ltd.) to make 3,000 copies.

The developers of examples 7 and 8 which used toner 2 were used in a digital electrophotographic copying machine model Di-30 (Minolta Co., Ltd.) to make 3,000 copies.

The developers were evaluated for environmental resistance, fogging, filming on the photosensitive member, and flow characteristics.

Environmental Resistance

The difference in charging ($\mu$C/g) under environmental conditions of high temperature and high humidity (H/H; 30° C., 85% humidity) and low temperature and low humidity (L/L: 10° C., 15%) were measured. Evaluation was made according to the following rankings.

◎: Less than 10 $\mu$C/g (Very good)

○: 10~15 $\mu$C/g (Good or no problem for practical use)

×: more than 15 $\mu$C/g (Problematic for practical use)

Fog

Under environmental conditions of high temperature and high humidity (H/H; 30° C., 85% humidity) and low temperature and low humidity (L/L: 10° C., 15%), 3,000 copies were made. Evaluation was made according to the following rankings.

◎: Very good under both H/H and L/L conditions

○: Good under both H/H and L/L conditions and no problem for practial use

TABLE 1

| | 2nd additive (Silica) | | | 1st additive (Titania or Alumina) | | | | | |
|---|---|---|---|---|---|---|---|---|---|
| | Type | Amt.* | Specific surface area | Type | Amt.* | Specific surface area | Toner | Carrier | $\sqrt{S_1^2+S_2^2}$ |
| Ex. 1 | I | 0.4 | 560 | A | 0.7 | 770 | 1 | 1 | 952 |
| Ex. 2 | I | 0.4 | 560 | A | 0.7 | 770 | 1 | 2 | 952 |
| Ex. 3 | I | 0.15 | 210 | A | 0.8 | 880 | 1 | 1 | 904 |
| Ex. 4 | II | 0.3 | 675 | A | 0.8 | 880 | 1 | 1 | 1109 |
| Ex. 5 | II | 0.15 | 337.5 | A | 1.0 | 1100 | 1 | 1 | 1150 |
| Ex. 6 | II | 0.1 | 225 | A | 0.5 | 550 | 1 | 1 | 594 |
| Ex. 7 | II | 0.1 | 225 | A | 0.5 | 550 | 2 | 1 | 594 |
| Ex. 8 | II | 0.1 | 225 | A | 0.5 | 550 | 2 | 3 | 594 |
| Ex. 9 | III | 0.4 | 280 | A | 0.7 | 770 | 1 | 1 | 819 |
| Ex. 10 | I | 0.3 | 420 | B | 0.8 | 640 | 1 | 1 | 765 |
| Ex. 11 | I | 0.35 | 490 | D | 0.65 | 585 | 1 | 1 | 763 |
| Ref Ex. 1 | I | 0.5 | 700 | — | — | — | 1 | 1 | (700) |
| Ref Ex. 2 | — | — | — | A | 0.9 | 990 | 1 | 1 | (990) |
| Ref Ex. 3 | I | 0.4 | 560 | A | 0.2 | 220 | 1 | 1 | 601 |
| Ref Ex. 4 | I | 0.1 | 140 | A | 0.25 | 275 | 1 | 1 | 308 |
| Ref Ex. 5 | I | 0.4 | 560 | A | 1.3 | 1430 | 1 | 1 | 1535 |
| Ref Ex. 6 | II | 0.4 | 900 | A | 0.5 | 550 | 1 | 1 | 1054 |
| Ref Ex. 7 | II | 0.4 | 900 | A | 1.0 | 1100 | 1 | 1 | 1421 |
| Ref Ex. 8 | I | 0.6 | 840 | B | 0.4 | 320 | 1 | 1 | 898 |
| Ref Ex. 9 | I | 0.7 | 980 | C | 0.5 | 175 | 1 | 1 | 995 |

*Added amount: amount added (g) per 100 g of toner

×: Problematic for practical use under at least one condition

×: Excessive filming and problematic for practical use

Flow Characteristics

Aerated apparent specific gravity was measured using a powder tester (Hosokawa Micron K.K.), and solid image follow-up characteristics were evaluated and ranked as shown below. Solid image follow-up characteristics were evaluated by the density difference of the leading and trailing portions of a linear solid image using a vertically fed (portrait) A4 sheet. Evaluation was made according to the following rankings.

◎: Aerated apparent specific gravity of 0.44~0.48, good solid image follow-up characteristics ○: Aerated apparent specific gravity of 0.38 or more but less than 0.44, solid image follow-up characteristics pose no practical problem ×: Aerated apparent specific gravity of less than 0.38, solid image follow-up characteristics are poor and problematic for practical use The evaluation results are shown in Table 2 below.

TABLE 2

| | Environmental Resistance | Fog | Flow Characteristics (apparent specific gravity) |
|---|---|---|---|
| Ex. 1 | ◎ | ◎ | ◎ (0.46) |
| Ex. 2 | ◎ | ◎ | ◎ (0.46) |
| Ex. 3 | ◎ | ○ | ◎ (0.45) |
| Ex. 4 | ◎ | ◎ | ◎ (0.46) |
| Ex. 5 | ◎ | ◎ | ◎ (0.46) |
| Ex. 6 | ◎ | ◎ | ○ (0.40) |
| Ex. 7 | ◎ | ◎ | ○ (0.40) |
| Ex. 8 | ◎ | ◎ | ○ (0.40) |
| Ex. 9 | ◎ | ◎ | ◎ (0.45) |
| Ex. 10 | ◎ | ○ | ○ (0.43) |
| Ex. 11 | ◎ | ○ | ○ (0.42) |
| Ref. 1 | X | ○ | ◎ (0.44) |
| Ref. 2 | ◎ | X | ○ (0.43) |
| Ref. 3 | X | ○ | ○ (0.43) |
| Ref. 4 | ○ | ○ | X (0.36) |
| Ref. 5 | ◎ | ○ | ◎ (0.47) |
| Ref. 6 | X | ○ | ◎ (0.46) |
| Ref. 7 | ○ | ○ | ◎ (0.47) |
| Ref. 8 | X | ○ | ◎ (0.45) |
| Ref. 9 | X | ○ | ◎ (0.46) |

In reference example 1, image density was reduced under L/L conditions.

In reference example 2, charge levels were reduced under H/H conditions, and fog appeared after 1,500 copies.

In reference example 4, solid image follow-up characteristics were extremely poor.

In reference example 6, the charge increased under L/L conditions, and image density was reduced.

In reference examples 8 and 9, image density was reduced under L/L conditions.

In examples 1~11, none of the previously described problems occurred.

Although the present invention has been fully described by way of examples with reference to the accompanying drawing, it is to be noted that various changes and modifications will be apparent to those skilled in the art.

Therefore, unless otherwise such changes and modifications depart from the scope of the present invention, they should be construed as being included therein.

What is claimed is:

1. A developer for developing an electrostatic latent image comprising:

toner particles comprising a colorant and a binder resin, said toner particles having a volume-average particle size of 5 to 10 $\mu$m;

a first exterior additive comprising a hydrophobic anatase titanium oxide powder; and a second exterior additive comprising a silica powder; said developer satisfying following relationships:

$$S_1 > S_2,$$

$$400 < \sqrt{(S_1^2 + S_2^2)} \leq 1300,$$

$$500 \leq S_1 \leq 1000,$$

$$500 \leqq S_1 \leqq 1000,$$

wherein $S_1$ ($m^2$) denotes total specific surface area of the first additive per 1 kg of the toner particles and $S_2$ ($m^2$) denotes that of the second additive, wherein said total specific surface areas $S_1$ and $S_2$ are represented by following formulas:

$$S_1 = A_1 \cdot B_1$$

$$S_2 = A_2 \cdot B_2$$

wherein $A_1$ ($m^2/g$) denotes BET specific surface area of the first additive and is in the range of 70 to 200 $m^2/g$, $A_2$ ($m^2/g$) denotes BET specific surface area of the second additive and is in the range of 50 to 300 $m^2/g$, $B_1$ (g) denotes content of the first additive per 1 kg of the toner particles, and $B_2$ (g) denotes content of the second additive per 1 kg of the toner particles;

said developer having improved flow characteristics when the first and second exterior additives are added to the toner particles.

2. The developer as claimed in claim 1 wherein said total specific surface area $S_2$ satisfies following relationship:

$$100 \leqq S_2 \leqq 700.$$

3. The developer as claimed in claim 1 wherein said specific surface area $A_1$ is in the range of 80 to 150 $m^2/g$ and said specific surface area $A_2$ is in the range of 70 to 250 $m^2/g$.

4. The developer as claimed in claim 1 wherein said first additive has an average particle size of 5 to 50 nm.

5. The developer as claimed in claim 1 wherein said first additive is treated with a silane coupline agent by dispersing said first additive into an aqueous medium.

6. The developer as claimed in claim 1 wherein said toner particles further comprise 0.1 to 10 parts by weight of off-set preventing agent per 100 parts by weight of the binder resin.

7. The developer as claimed in claim 6 wherein said binder resin is made of a mixture comprising a first polyester resin and a second polyester resin, wherein said second polyester resin has a softening point different from a softening point of said first polyester resin.

8. A developer for developing an electrostatic latent image comprising:

toner particles comprising a colorant and a polyester resin, said toner particles having a volume-average particle size of 5 to 10 $\mu$m, wherein said polyester resin has a number average molecular weight (Mn) of 3,000 to 6,000, a ratio of a weight average molecular weight (Mw) to the number average molecular weight Mw/Mn of 2 to 6, a glass transition point of 50° C. to 70° C., and a softening point of 90° C. to 110° C.;

a first exterior additive comprising a hydrophobic anatase titanium oxide powder; and a second exterior additive comprising a silica powder; said developer satisfying following relationships:

$$S_1 > S_2,$$

$$400 < \sqrt{(S_1^2 + S_2^2)} \leq 1300,$$

$$500 \leq S_1 \leq 1000,$$

$$500 \leqq S_1 \leqq 1000,$$

wherein $S_1$ ($m^2$) denotes total specific surface area of the first additive per 1 kg of the toner particles and $S_2$ ($m^2$) denotes that of the second additive, wherein said total specific surface areas $S_1$ and $S_2$ are represented by following formulas:

$$S_1 = A_1 \cdot B_1$$

$$S_2 = A_2 \cdot B_2$$

wherein $A_1$ ($m^2/g$) denotes BET specific surface area of the first additive and is in the range of 70 to 200 $m^2/g$, $A_2$ ($m^2/g$) denotes BET specific surface area of the second additive and is in the range of 50 to 300 $m^2/g$, $B_1$ (g) denotes content of the first additive per 1 kg of the toner particles, and $B_2$ (g) denotes content of the second additive per 1 kg of the toner particles;

said developer having improved flow characteristics when the first and second exterior additives are added to the toner particles.

9. The developer as claimed in claim 8 wherein said polyester resin is produced with bisphenol A polyoxypropylene adduct, bisphenol A polyoxyethylene adduct, aliphatic dicarboxylic acid, and aromatic dicarboxylic acid.

10. The developer as claimed in claim 8 wherein said polyester resin is produced with bisphenol A polyoxypropylene adduct, bisphenol A polyoxyethylene adduct, aliphatic dicarboxylic acid, aromatic dicarboxylic acid, and polyvalent carboxylic acid.

11. The developer as claimed in claim 8 wherein said polyester resin comprises a component being soluble into tetrahydrofuran.

12. The developer as claimed in claim 8 wherein said total specific surface area $S_2$ satisfies following relationship:

$$100 \leqq S_2 \leqq 700.$$

13. The developer as claimed in claim 8 wherein said specific surface area $A_1$ is in the range of 80 to 150 $m^2/g$ and said specific surface area $A_2$ is in the range of 70 to 250 $m^2/g$.

14. The developer as claimed in claim 8 wherein said first additive has an average particle size of 5 to 50 nm.

15. The developer as claimed in claim 8 which is a mono-component developer.

16. The developer as claimed in claim 8 which is a two-component developer comprising carrier particles.

17. The developer as claimed in claim 16 wherein said carrier particles comprise magnetic particles coated with a resin obtained by reacting isocyanate with a copolymer of organopolysiloxane and vinyl monomer.

* * * * *